US006132670A

United States Patent [19]

Lu

[11] Patent Number: 6,132,670

[45] Date of Patent: Oct. 17, 2000

[54] MELT SPINNING PROCESS AND APPARATUS

[75] Inventor: Fumin Lu, Tamarac, Fla.

[73] Assignee: Ason Engineering, Ltd., Ft. Lauderdale, Fla.

[21] Appl. No.: 09/200,280

[22] Filed: Nov. 24, 1998

Related U.S. Application Data

[60] Provisional application No. 60/066,816, Nov. 26, 1997.

[51] Int. Cl.[7] ..... D01D 5/12; D04H 3/03

[52] U.S. Cl. ..... 264/555; 264/103; 264/210.8; 264/211.14

[58] Field of Search ..... 264/103, 210.8, 264/211.14, 555

[56] References Cited

U.S. PATENT DOCUMENTS

| | | | |
|---|---|---|---|
| 5,034,182 | 7/1991 | Sze et al. | 264/555 |
| 5,141,700 | 8/1992 | Sze et al. | 264/555 |
| 5,545,371 | 8/1996 | Lu | 264/555 |
| 5,688,468 | 11/1997 | Lu | 264/555 |

*Primary Examiner*—Leo B. Tentoni
*Attorney, Agent, or Firm*—Malin, Haley & DiMaggio, P.A.

[57] ABSTRACT

A process for spinning polymeric filaments into yarn at high spinning speeds for producing yarn of high quality that includes the steps of extruding molten polymer through a spinneret, providing an aspirator at a preselected position relative to the slinneret and, after start up, adjusting the aspirator distance from the spinneret thereby moving the aspirator drawing force closer to the spinneret, forming a yarn path made from the filaments, supplying a finish to the yarn, and drawing the yam up with a take up wheel The spinning speed of the yarn on the take up reel is increased while moving the aspirator containing the drawing force within five to fifty centimeters to the spinneret. Using this method much higher filament velocities can be reached (above 10,000 meters per minute) without breaking the filaments or the yarn. The essence of the present invention is to be able to alter the position of the drawing for exerted on filaments from the aspirator to within a close distance to the spinneret where material is still in a molten stage and the spin line tensions maximally reduced thereby allowing the take up wheel speed to be significantly increased without breaking the filaments.

7 Claims, 2 Drawing Sheets

MELT SPINNING PROCESS AND APPARATUS

This application is based on Provisional Application Ser. No. 60,066,816 filed Nov. 26, 1997.

BACKGROUND OF THE INVENTION

1. Field of the Invention

This invention relates generally to an improved process for melt spinning uniform polymeric filaments into fully oriented yarn, and specifically, to a method and apparatus for spinning polymeric filaments into yarn at high spinning speeds while producing a yarn of high quality.

2. Description of the Background Art

The process of making yarn by melt spinning uniform polymetric filaments through capillaries in a spinneret is well known. Molten polymetric filaments are extruded and withdrawn by a mechanical force from a take-up reel and/or with a high velocity airstream. The finished yarn is wound on a bobbin. The yarn is also treated during the process with an anti-static lubricant called a finish.

U.S. Pat. No. 5,141,700 describes a conventional melt spinning process and device that utilizes positive mechanical drawing with a concurrent flow of gas to assist the withdrawal of the filaments.

Heightened yarn spinning speeds achievable today may run from 7,000 to 10,000 meters per minute velocity of the yarn. The yarn velocity has controlling limits. The first limit is the commercial mechanical speed available from the take-up reel and bobbin. The second speed limit depends on the interaction between properties of material being produced and processing conditions being used in that higher filament speed can be achieved if the drawing force closer to the spinneret surface can be exerted on the filaments where the temperature of the filaments are still high and hence the elongational viscosity is low which allows the filaments to be readily drawn at higher rate without forcing the filaments to break.

The production of partially oriented yarns allows filament spinning speeds up to 3,000 to 4,000 mpm according to the formula of V(f) equals Q÷d×9,000 where V(f) is filament velocity, Q is throughput grams per hole per minute and d is the filament denier as d is designed for end products. Q is proportioned to V(f). The higher the filament velocity we can reach, the higher production and throughput. The reason for filament speeds of 4,000 mpm reached in partial oriented yarn production limits is probably that the filament or the melt exiting from the orifice of the spinneret is cooled down much too soon and too fast, therefore causing the elongation viscosity of the polymer melt to increase too quickly and too high resulting in high spin line tension. If one were to increase the take-up speed or the draw down force more, it would simply force the filaments to break.

SUMMARY OF THE INVENTION

A continuous melt spinning process for filament spinning to create fully oriented yarn that includes the steps of:

(a) extruding molten polymer through a spinneret, having either round or other shape apertures;

(b) providing an aspirator at a preselected position relative to said spinneret, said aspirator having a variable drawing force exerted on the molten extruded filaments with varying of pressure of an airstream; a) after start-up, adjusting the aspirator distance from the spinneret and moving the aspirator drawing force closer to the spinneret provided by the airstream;

(c) forming a yarn path made from the filaments;

(d) supplying a finish to the yarn;

(e) drawing the yarn with a take-up reel; and (f) increasing the spinning speed of the yarn on the take-up reel while moving the aspirator containing the drawing force of the airstream within five to fifty centimeters to the spinneret in order to provide a drawing force on the filaments at a point where the filaments are still high in temperature and low in viscosity and thereby reducing the spin line tension and varying the overall spinning speed without breaking the filaments.

For fully oriented yarn production, the take-up reel provides a mechanical drawing force on the yarn and has a variable speed device to increase the take-up reel speed in conjunction with the position of the aspirator providing the drawing force on the filaments close to the spinneret, resulting in filament spinning speed increased without filament breakage to occur as a result of the reduced filament tension and improved filament stretchability caused by the additional drawing force from the aspirator next to the spinneret.

At start-up, the aspirator is positioned below the spinneret at a pre-selected distance where the threading through the aspirator can be readily accomplished at a yarn speed low enough to make the threading easier. Once the yarn forming process has begun, the pressure of the airstream to the aspirator is slowly increased while simultaneously as the yarn spinning speed is increased, the position of the aspirator is then adjusted, in a range of 5 to 50 centimeters from the spinneret according to the product requirement in terms of filament denier and velocity desired. As a result, the filaments at high exit temperature will stretch but not break at higher draw speeds.

In this way a much higher filament velocity (and yarn velocity) can be reached above 10,000 meters per minute without breaking the filaments or the yarn.

The essence of the present invention is to be able to alter the position of the drawing force exerted on filaments from the aspirator to within a close distance to the spinneret wherein the material is still in a molten state and the spin line tension is maximally reduced, therefore allowing the take-up reel speed to be significantly increased without breaking the filaments.

It is an object of this invention to provide an improved method for melt spinning uniform polymeric filaments through capillaries in a spinneret in order to increase the ability of the yarn production to achieve high velocity of above 10,000 meters per minute and produce a high quality, fully oriented yarn made of polymeric filaments.

It is another object of the present invention to provide an improved melt spinning process to increase the flexibility of the yarn production to produce a wide range of products in terms of filament denier and polymer materials with high production rate and low production cost.

It is yet still another object of the present invention to provide an improved method to produce high quality yarns with desired filament structure and properties to achieve technical advantages for industrial and textile purposes.

These and other objects according to the present invention can be accomplished by adding an additional aspirator on the spin line, close to the spinneret and capable of adjusting the distance from the spinneret, to impose a drag force on the filaments at a point where the filaments are still high in temperature and low in elongational viscosity which will become apparent hereinafter, the instant invention will now be described with particular reference to the accompanying drawings.

DESCRIPTION OF THE PREFERRED EMBODIMENTS

Figure 1:
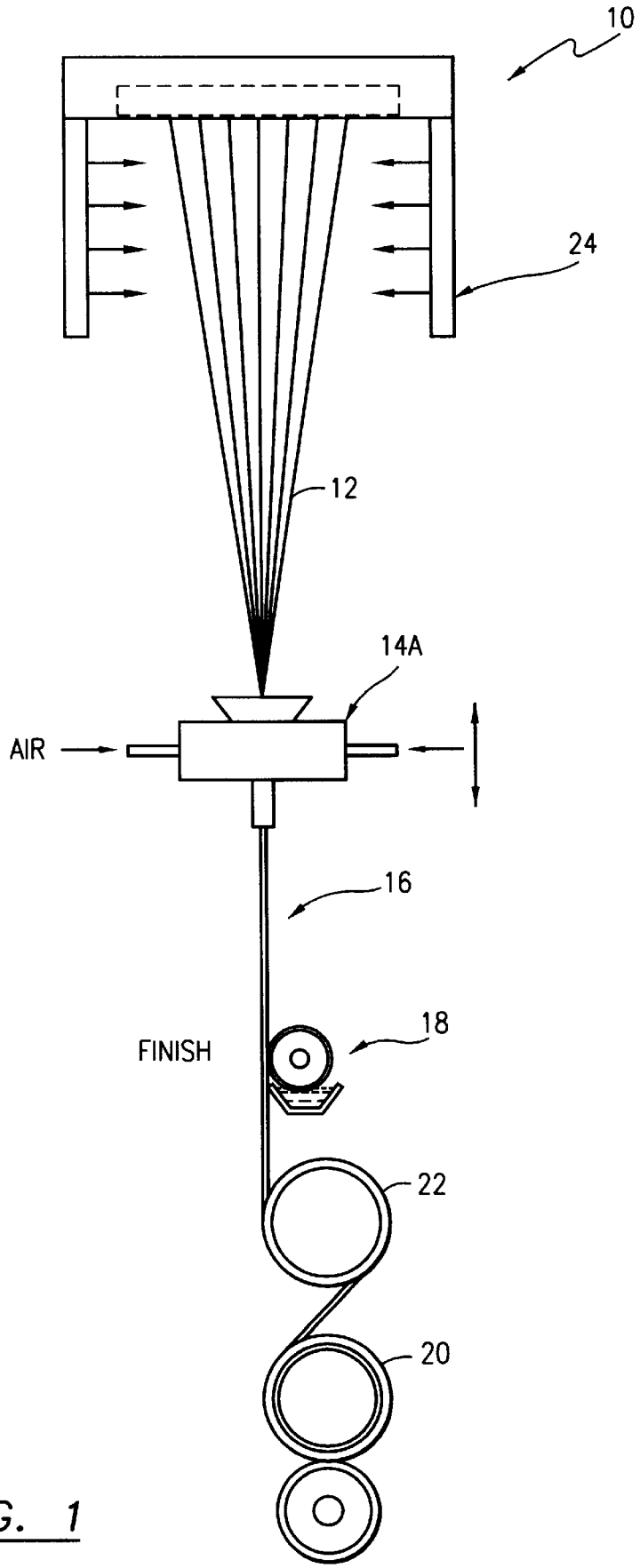
FIG. 1 shows a schematic representation of an apparatus used in the present invention.

Referring now to FIG. 1, a spinneret 10 is shown through which the molten polymers 12 are extruded through capillaries which can be either round or other shapes and from which the molten filaments 12 emerge. An aspirator 14A is along the spin line. The aspirator 14A is supplied with pressurized air creating a suction force by pressure differential over the length of the aspirator to the filaments 12, pulling them away from the spinneret 10. The aspirator 14A can be moved closer or farther away from the spinneret 10 in conjunction with the overall control of the process. The drawing force from the aspirator on the filaments 12 can also be increased or decreased. The yarn 16 then proceeds to a finishing area 18 where a finish is applied to the yarn 16. The yarn is drawn by a take-up reel 20 and drawn onto a bobbin 22 where the yarn is stored. The take-up reel 20 assists in the spinning process and operates at sufficient speeds to achieve above 10,000 meters per minute of yarn production.

To operate the invention, the aspirator 14A is positioned at a pre-determined distance below the spinneret 10 and the air drawing force in the aspirator 14A is so chosen as to make threading very easy to accomplish. The position of the aspirator and the pressure of the air supplied to the aspirator is then adjusted according to the product requirement to allow final filament spinning speed up to 10,000 meters per minute or higher to be reached with the speed of take-up reel 20 to produce desired product.

The yarn produced can be used for textile and industrial uses.

By increasing the yarn spinning velocity to above 10,000 meters per minute, the yarn production is greatly increased. This production increase of yarn still maintains the high quality of the resultant yarn.

As shown in FIG. 1, a quench may also be used to assist in the cooling process without changing the fundamental principles of the invention. By putting the drawing force closer to the spinneret while the filaments are still more stretchable because of their molten and high temperature, a greater speed can be achieved without breaking the filaments. This results in faster yarn speeds.

Figure 2:
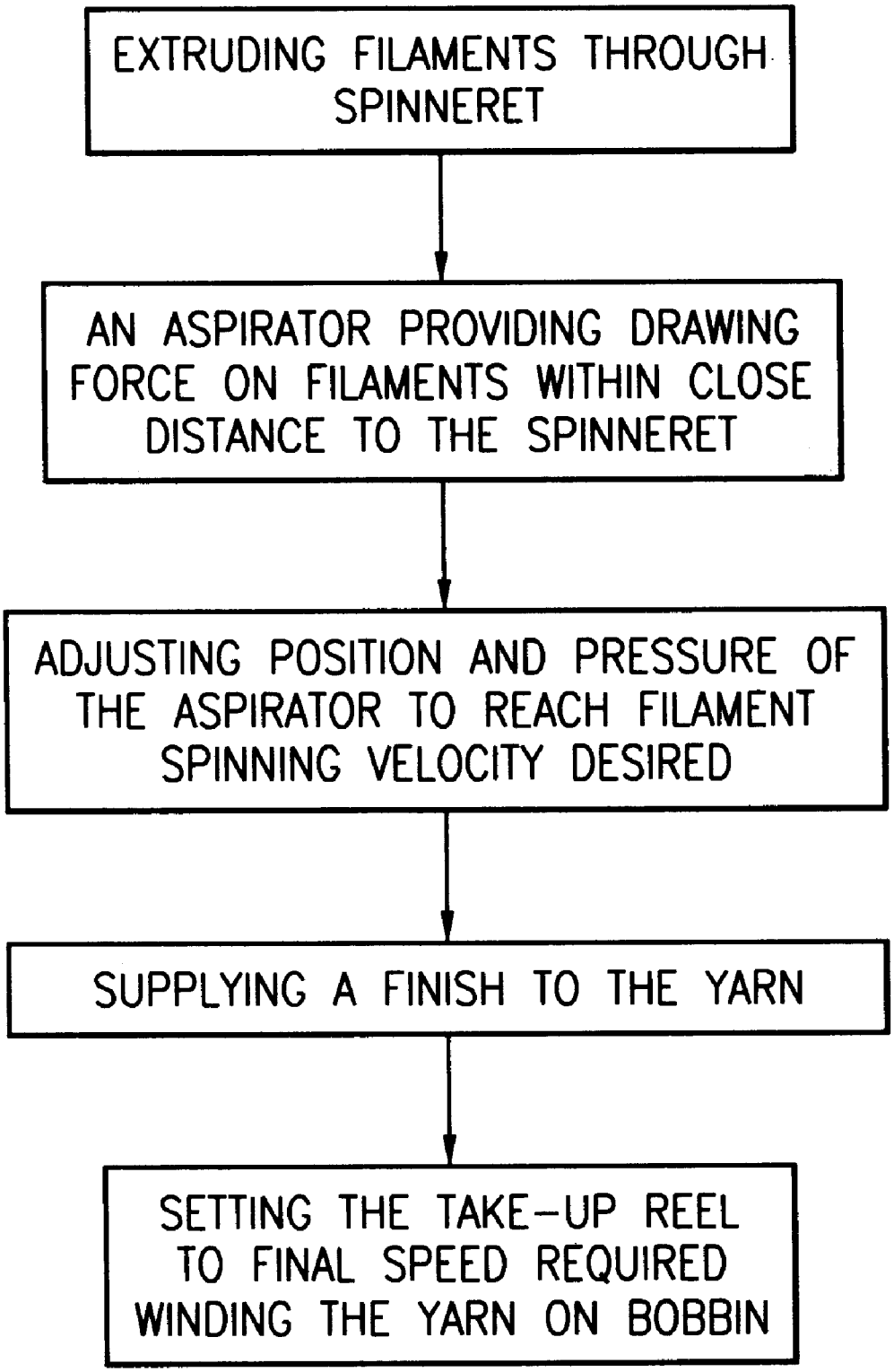
FIG. 2 shows a flow chart showing the method of accomplishing the improved invention.

FIG. 2 shows the process beginning with the step of extruding filaments from the spinneret and providing an aspirator for filament drawing that is movable relative to the spinneret surface. The aspirator is initially positioned away from the spinneret at a pre-selected distance. Once the filament threading process is complete, the position of the aspirator is adjusted within a close distance of between 5 to 50 cm to the spinneret and the air pressure to the aspirator is also adjusted to accommodate the requirement of high filament velocity determined by the speed of the take-up reel. Therefore, filament spinning velocity of 10,000 meters per minute or higher is achievable.

EXAMPLE 1

Polypropylene resin of 35 MFR was melted and extruded from an extruder having a screw of 1.25 cm in diameter at melt temperature of 230° C. through a round spinneret having 8 orifices of 0.4 mm in diameter at througput 2.5 grams per hole per minute. An aspirator located 50 cm below the spinneret with supply of air stream of 2 kg/cm$^2$ sucked in the extruded filaments. The aspirator was then moved up to the distance of 25 cm from the spinneret and the pressure of the air stream supplied to the aspirator was also raised to 4.5 kg/cm$^2$. The filaments of 1.8 denier with birefringence of 0.024 were produced. The filament spinning velocity reached was 12,500 meters per minute.

EXAMPLE 2

Polyethylene terephthalate resin having intrinsic viscosity of 0.64 was spun with the same equipment as described in example 1 at melt temperature of 295° C. and throughput of 4 grams per hole per minute. The spinning process was started with the aspirator positioned 20 cm below the spinneret and supplied with compressed air of 2 kg/cm$^2$ and the throughput was initially set at 1.0 gram per hole per minute. Once the spinning process was established, the throughput was then increased to 4.0 grams per hole per minute as the pressure of the air to the aspirator was raised to 5 kg/cm$^2$. PET filament of 2.5 denier with birefringence of 0.13 was obtained.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A melt spinning process for producing a multifilament yarn of a plurality of continuous individual filaments of thermoplastic polymers, comprising the steps of:

extruding the molten polymer through a spinnert with multiple rows of orifices, subjecting the emerging filament immediately to a drawing force provided by an aspirator located within a region between 5 and 50 centimeters to the spinneret, forming into a yarn of a bundle of individual filaments, subjecting the freshly formed bundle of filaments to a preparation treatment with antistatic finish and subsequently winding said filaments on a bobbin driven by the take-up reel.

2. The process as defined in claim 1 wherein the quantity and the pressure of the air stream supplied to the aspirator can be varied to adjust the speed of the air stream.

3. The process as defined in claim 1 wherein the winding of the filament bundle on a bobbin at a speed in excess of 10,000 m/min.

4. The process as defined in claim 1 comprising the steps of:

extruding a plurality of filaments by melt spinning through a spinneret of multiple rows of orifices from a thermoplastic polymer;

subjecting the filaments to a drawing force from an aspirator positioned below the spinneret at predetermined distance supplied with compressed air stream of less than 2 kg/cm$^2$, Increasing the pressure of the air stream supplied to the aspirator while increasing the speed of the take-up reel;

conducting the filament bundle from the aspirator through a device of supplying a finish to the filament bundle and to winding the yarn on a bobbin.

5. The process as defined in claim 1 comprising the steps of:

extruding a plurality of filaments by melt spinning through a spinneret of multiple rows of orifices from a thermoplastic polymer;

subjecting the filaments to a drawing force from an aspirator positioned below the spinneret at pre-determined distance supplied with compressed air stream;

adjusting the position of the aspirator to a closer distance from the spinneret while increasing the speed of the take-up reel;

conducting the filament bundle from the aspirator through a device of supplying a finish to the filament bundle and to winding the yearn on a bobbin.

6. The process as defined in claim 1 comprising steps of:

extruding a plurality of filaments by melt spinning through a spinneret of multiple rows of orifices from a thermoplastic polymer;

subjecting the filaments to a drawing force from an aspirator positioned below the spinneret at pre-determined distance supplied with compressed air stream of low pressure;

adjusting the position of the aspirator to a closer distance from the spinneret and increasing the pressure of the air stream supplied to the aspirator while increasing the speed of the take-up reel;

conducting the filament bundle from the aspirator through a device of supplying a finish to the filament bundle and to winding the yarn on a bobbin.

7. The process as defined in claim 1 comprising steps of:

extruding a plurality of filaments by melt spinning through a spinneret of multiple rows of orifices from a thermoplastic polymer;

subjecting the filaments to a drawing force from an aspirator positioned below the spinneret at pre-determined distance supplied with compressed air stream at pre-determined pressure;

adjusting the speed of the take-up reel required by the product;

conducting the filament bundle from the aspirator through a device of supplying a finish to the filament bundle and to winding the yarn on a bobbin.

* * * * *